US005984584A

United States Patent [19]

McMillan et al.

[11] Patent Number: 5,984,584

[45] Date of Patent: Nov. 16, 1999

[54] FAIRINGS FOR DRILLING RISER CONTROL POD HOSES

[75] Inventors: David Wayne McMillan, Deer Park, Tex.; Early Baggett Denison, New Orleans, La.; Richard Bruce McDaniel, Houston, Tex.

[73] Assignee: Shell Oil Company, Houston, Tex.

[21] Appl. No.: 08/853,727

[22] Filed: May 9, 1997

Related U.S. Application Data

[60] Provisional application No. 60/017,263, May 10, 1996.

[51] Int. Cl.[6] ..... E02B 11/38; E21B 7/12; F15D 1/10

[52] U.S. Cl. ..... 405/195.1; 114/243; 166/359; 405/224; 405/211

[58] Field of Search ..... 405/195.1, 224, 405/224.1–224.4, 223.1, 216, 211; 166/350, 359, 367; 114/243

[56] References Cited

U.S. PATENT DOCUMENTS

| | | | |
|---|---|---|---|
| 4,078,605 | 3/1978 | Jones | 405/224 X |
| 4,398,487 | 8/1983 | Ortloff et al. | 166/267 X |
| 4,474,129 | 10/1984 | Watkins et al. | 114/243 |
| 5,410,979 | 5/1995 | Allen et al. | 114/243 |
| 5,456,199 | 10/1995 | Kernkamp | 114/243 X |
| 5,678,504 | 10/1997 | Toplosky et al. | 114/243 |
| 5,722,340 | 3/1998 | Sweetmn | 405/211 |

FOREIGN PATENT DOCUMENTS

| | | | |
|---|---|---|---|
| 1465630 | 12/1966 | France | 114/243 |
| 0683150 | 11/1987 | U.S.S.R. | 114/243 |

OTHER PUBLICATIONS

Advertisement—Tri–Tech Systems, 17200 Park Row, Houston, Texas 77084–4925, Copyright 1992 Syntro Inc., pp.

*Primary Examiner*—Dennis L. Taylor
*Attorney, Agent, or Firm*—Mark A. Smith

[57] ABSTRACT

A fairing system is disclosed for protecting multiple, parallel, bundled but separate cylindrical elements deployed in offshore applications. The fairing system deploys a plurality of elongated fairing surface elements foldable about an axis with a connection system joining the elongated edges of the fairing surface elements in a folded manner about the axis. A plurality of thrust bearings are orthogonally connected across the fairing surface elements at each axial end and an axially extending circular rotational surface is defined by the interior of each of the folded fairing surface elements and a transverse edge of the thrust bearings connected thereto. This rotational surface has a diameter which circumscribes the multiple bundled cylindrical elements. A plurality of clamps interconnect the bundled, cylindrical elements and a bearing collar on the axial ends of the clamps is provided to receive the thrust bearings of the axial ends of the fairing elements.

11 Claims, 4 Drawing Sheets

FIG. 2
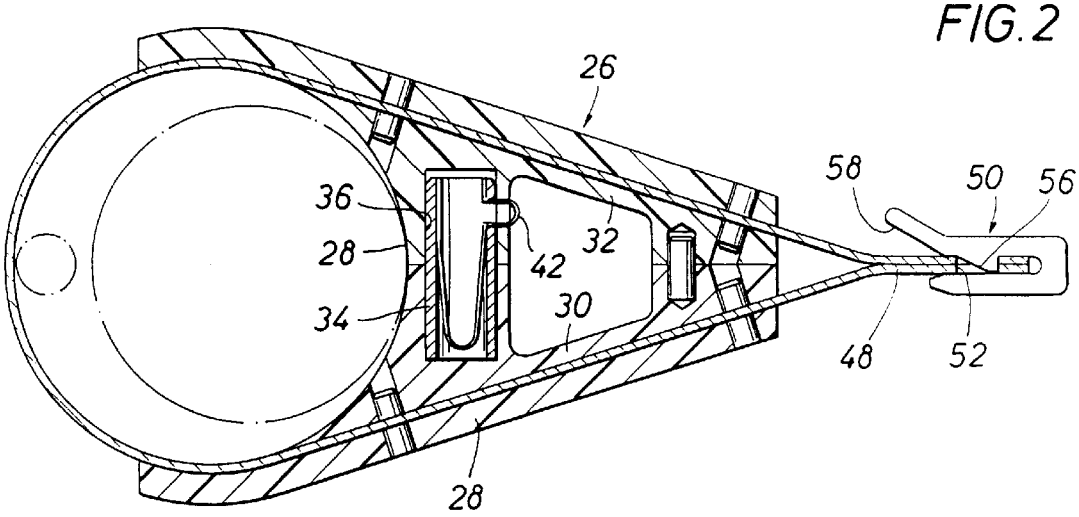
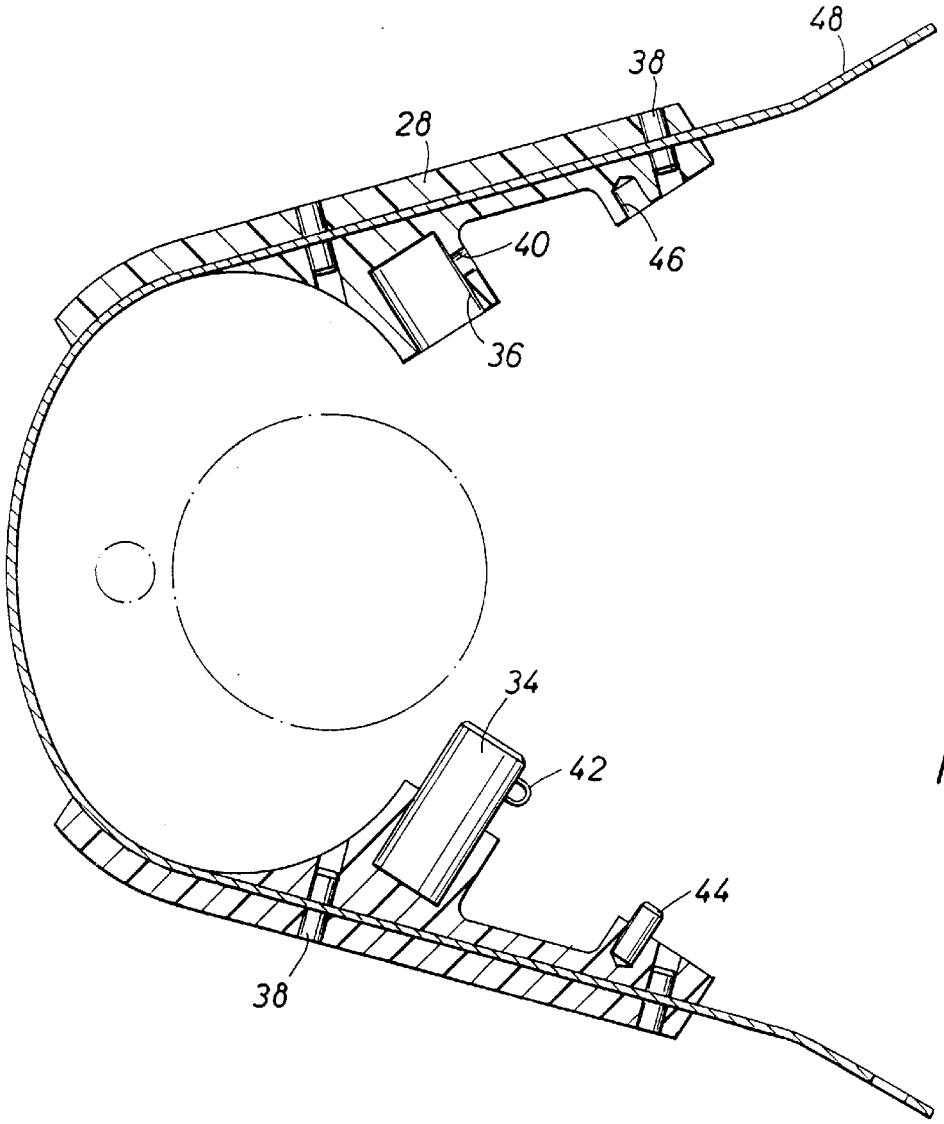
FIG. 3

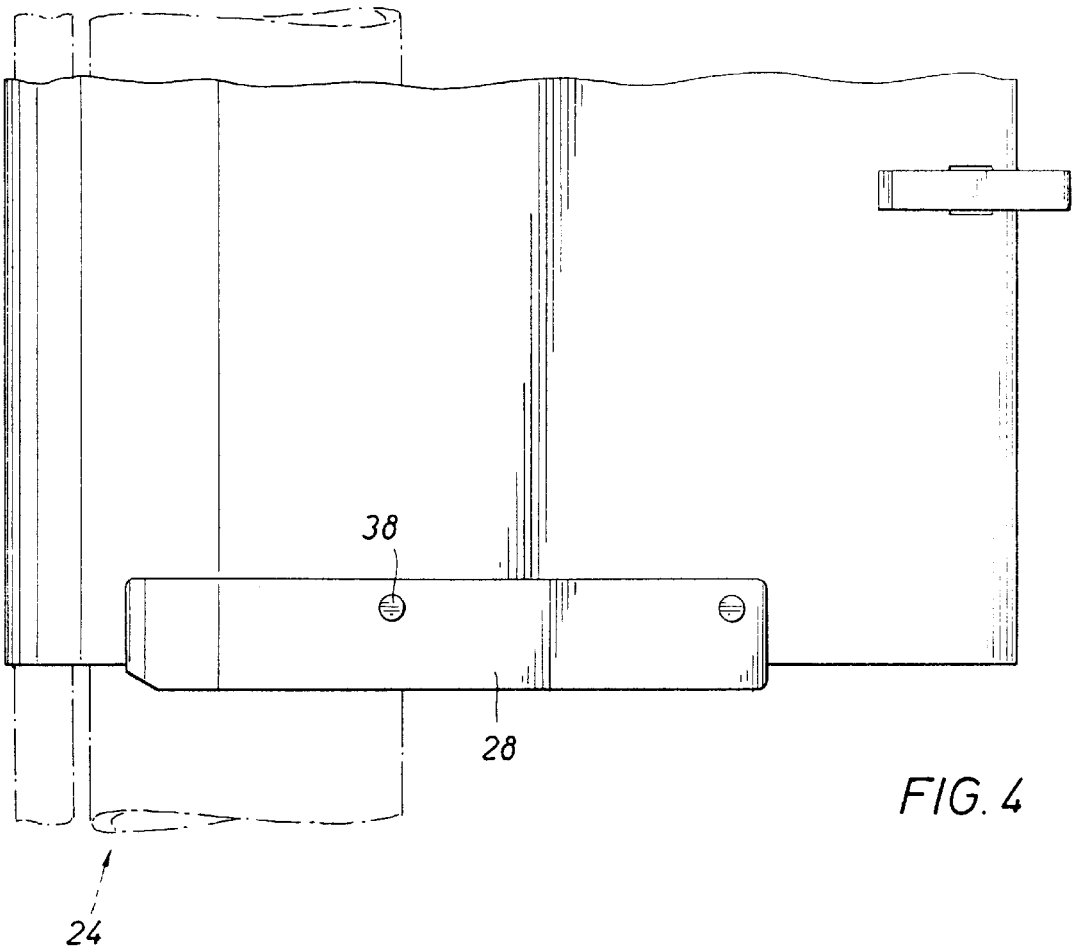
FIG. 4
FIG. 5
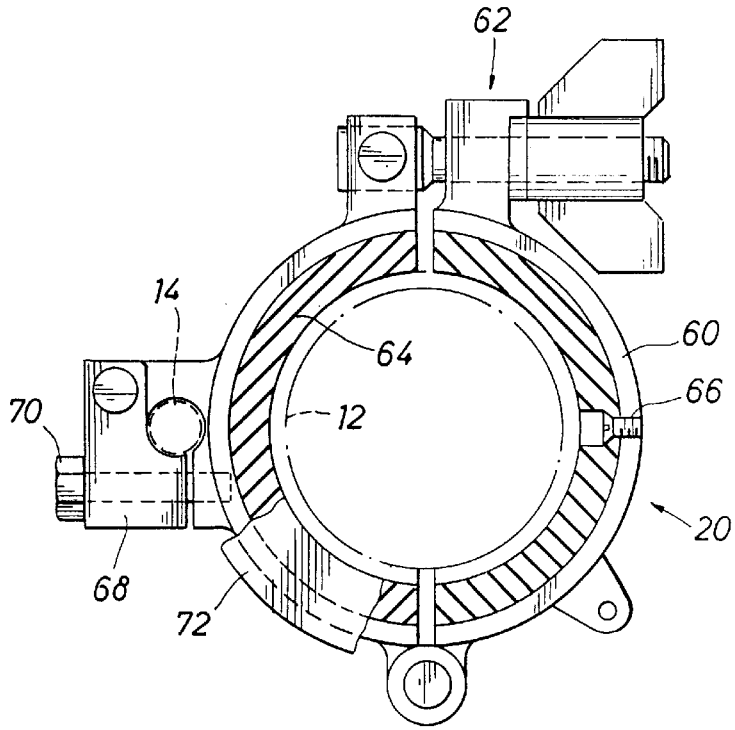

FAIRINGS FOR DRILLING RISER CONTROL POD HOSES

This application claims benefit of provisional application 60/017,263 filed May 10, 1996.

BACKGROUND OF THE INVENTION

The present invention relates to deepwater drilling and production operations. More particularly, the present invention relates to providing protection from vortex induced vibration ("VIV") to parallel runs of intermittently connected cylindrical elements such as drilling riser control pod hoses bundled with wirelines.

Assemblies of multiple cylindrical elements or lines such as these hoses and associated wirelines run from surface facilities to valve control pods which manage blow out preventors or "BOPs" on the ocean floor. The wireline provides support in deploying, maintaining, and retrieving the control pod hose and clamps interconnect the control pod hose to the wireline at regular intervals along their lengths. The control pod hose itself is a multiplex hose in which many hydraulic and/or electrical control lines are bundled within a single sheath. These control lines manipulate valves in the control pod of the BOP or otherwise control remote, subsea equipment.

Such applications require long runs which are subject to ocean currents. These currents can cause vortexes to shed from the sides of both the hose and the wireline, thereby inducing vibrations that can lead to the failure of either element or the clamps therebetween. Thus there is a need to provide protection from VIV in the control pod/support line assembly.

Helical strakes and the like, e.g., spiral wrapping ropes around the bundle, may be effective to reduce the VIV, but markedly increase current-induced drag. As a consequence, the bundled control pod hoses may be induced to "sail" past the risers and create tangling problems during rulnning and retrieval operations.

By contrast, fairings are effective to control both VIV and drag problems. However, the practice of using fairings such as deployed for VIV protection about single cylindrical elements are not suitable for such tandem or other multiple line assemblies.

An advantage of the fairing of the present invention is that it is suitable for deployment about bundled, i.e., side by side cylinders. Another advantage of the present invention is the ease of fairing installation about the cylinders.

SUMMARY OF THE INVENTION

Towards the fulfillment of the foregoing and other advantages, the present invention is a fairing system for protecting multiple, parallel, bundled but separate, side-by-side cylindrical elements deployed in offshore applications. The fairing system deploys a plurality of elongated fairing surface elements foldable about an axis with a connection system joining the elongated edges of the fairing surface elements in a folded manner about the axis. A plurality of thrust bearings are orthogonally connected across the fairing surface elements at each axial end and an axially extending circular rotational surface is defined by the interior of each of the folded fairing surface elements and a transverse edge of the thrust bearings connected thereto. This rotational surface has a diameter which circumscribes the multiple bundled cylindrical elements. A plurality of clamps interconnect the multiple bundled, cylindrical elements and a bearing collar on the axial ends of the clamps is provided to receive the thrust bearings of the axial ends of the fairing surface elements.

A BRIEF DESCRIPTION OF THE DRAWINGS

The brief description above, as well as further objects and advantages of the present invention, will be more filly appreciated by reference to the following detailed description of the preferred embodiments which should be read in conjunction with the accompanying drawings in which:

FIG. 2 is a cross sectional view of the fairing of FIG. 1, taken at line 2—2 in FIG. 1;

FIG. 3 is a top elevational view of the fairing of FIG. 2 in an open position during deployment about the control pod hose and support line;

FIG. 4 is a side elevational close-up view of the bottom of the fairing of FIG. 1;

FIG. 5 is a top elevational, partially broken away view of a clamp for connecting the control pod hose to the support line;

DETAILED DESCRIPTION OF AN ILLUSTRATIVE EMBODIMENT

Figure 1:
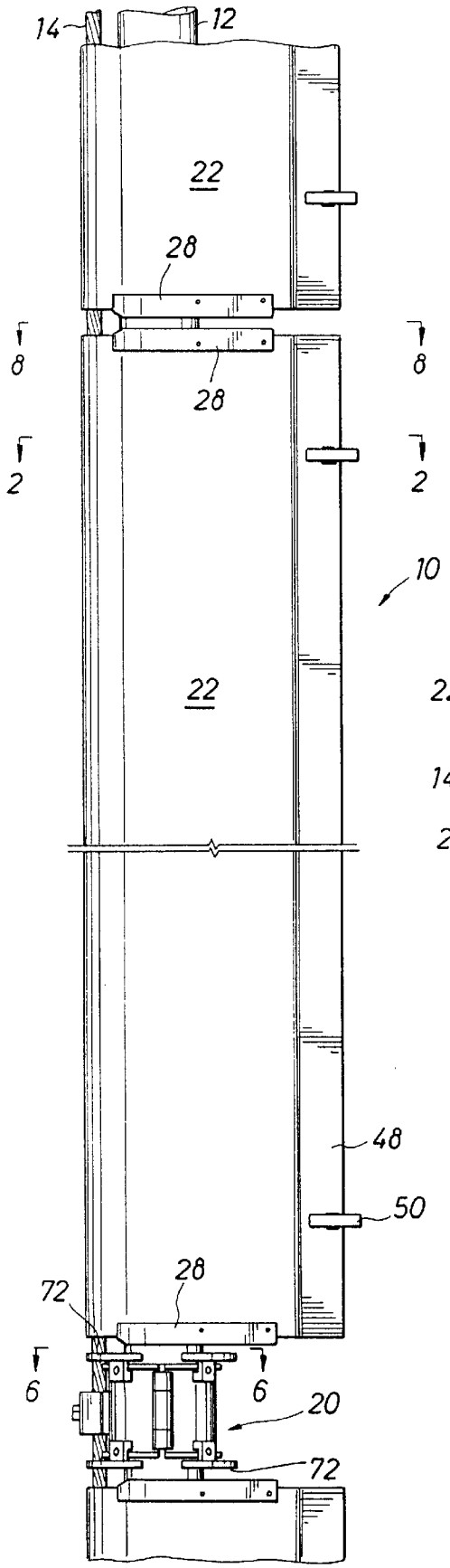
FIG. 1 is a side elevational view of a fairing in accordance with the present invention.
Figure 8:
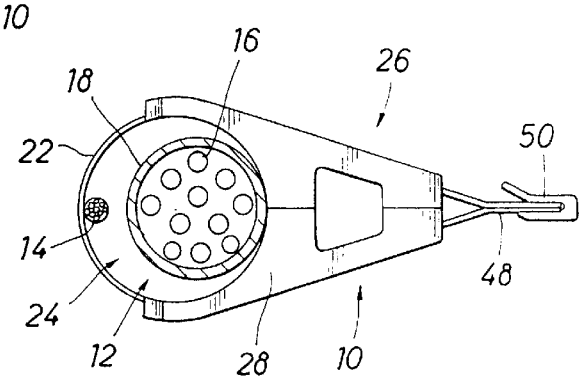
FIG. 8 is a cross sectional view of the control pod hose and support line of FIG. 1, taken at line 8—8 in FIG. 1.

FIG. 1 illustrates a fairing system 10 for protecting multiple, parallel, bundled but separate, side-by-side cylindrical elements in accordance with the present invention. For the purposes of illustration, this embodiment deploys the multiple, parallel, bundled but separate, side-by-side cylindrical elements in the form of a riser control pod hose 12 and a wireline 14. The riser control pod hose carries a plurality of hydraulic and/or electrical lines 16 (see FIG. 8) within a single sheath 18 for operating a BOP at the sea floor (not shown) during deepwater drilling operations. However, the invention is not limited to the illustrated embodiment and those skilled in the art could apply the present invention across a number of control line/flowline, control line/guideline or support line, or other offshore applications using two or more cylindrical elements which are adjacent, run parallel and are intermittently connected.

Returning to FIG. 1, the illustrated riser control pod hose application connects hose 12 to wireline or support line 14 at regular intervals through a plurality of clamps, here subsea umbilical clamps 20. Elongated fairing surface elements 22 are disposed between clamps 20. The fairing surface elements wrap or fold around the axis of the tandem cylindrical elements, here the drilling riser control pod hose/wireline assembly 24. In the illustration, the fairing surface element is formed from an elongated, rectangular sheet of resilient plastic or nylon and the sheet is elastically deformed into this shape. Alternatively, a hinged embodiment could be deployed from a more rigid material. The elongated edges of fairing surface elements 22 are joined into a VIV preventing fairing shape through a connection system 26.

FIGS. 2 and 3 illustrate an embodiment of connection system 26 in greater detail. In this embodiment, important elements of the connection system are formed integrally with thrust bearings or thrust bearing assembly 28 at the top and bottom of fairing surface elements 22. The thrust bearing is formed of first and second elements 30, 32 connected to opposing sides of the fairing surface element as it will fold into position. These first and second elements are attached to the top and bottom ends of the fairing surface element with pins or dowels 38. A latch pin 34 is mounted on the first element and a corresponding latch pin receptacle 36 is provided on the second element. The latch pin receptacle is provided a recess 40 and the latch pin itself is provided a spring loaded detent finger 42 arranged such that the detent finger will selectively engage the recess 40 to releasably secure the latch pin within the latch pin receptacle and hold the first and second elements of thrust bearing 28 together. It may also be useful to provide an alignment pin 44 and receptacle 46 across this interface.

In the illustrated embodiment the trailing edge of the fairing presents a tail 48. See also FIGS. 1 and 4. This tail can be conveniently secured with clips 50 snapping into aligned perforations 52 along the edge of the tail. Clips 50 are formed from a resilient material which spring biases finger 56 into the perforations 52. A guide 58 at the throat of the clip aids clip installation.

Figure 6:
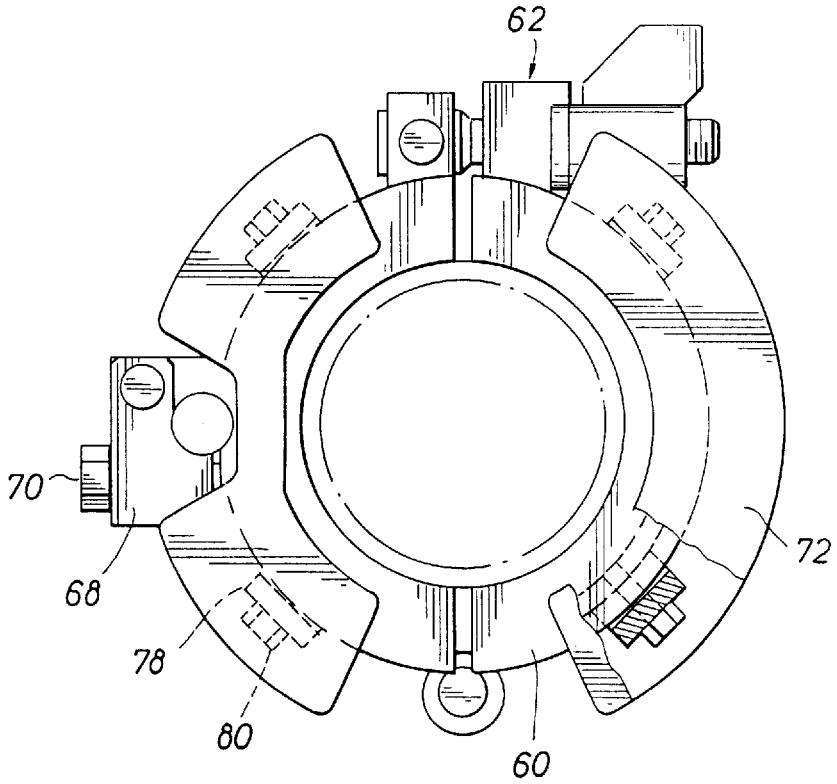
FIG. 6 is a cross sectional view of the control pod hose and messenger line of FIG. 1, taken at line 6—6 in FIG. 1.
Figure 7:
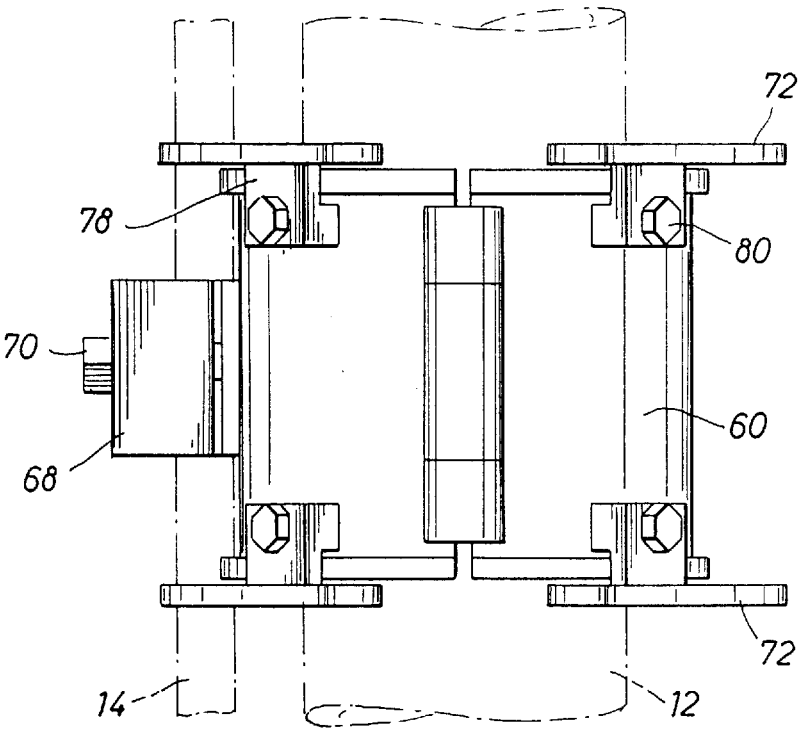
FIG. 7 is a side elevational view of a clamp for connecting the control pod hose to the messenger line.

FIGS. 5–7 provide detailed illustrations of one embodiment for Clamp 20. Here the clamp is a double clam-shell for hinged placement to secure the riser control pod hose/wireline connection. Main section 60 attaches about hose 12 and is secured with pivotally retained wing nut assembly 62. It may also be useful to line main section 60 with a non-slip, protective liner 64, here held in place with set screw 66. An auxiliary section 68 of clamp 20 is attached to main section 60 and attaches about the wireline. Here it is secured through bolt 70. Bearing collar 72 has been largely broken away from FIG. 5 to best illustrate these members.

Bearing collars 72 are placed on the top and bottom of clamp 20. These are best illustrated in FIGS. 6 which shows the bearing surface 74 and in FIG. 7 which illustrates attachment through flanges 78 and bolts 80. Bearing collars 72 of clamps 20 interface with the thrust bearings 28 on the fairings.

Thrust bearings 28 also provide an inner partially circumferential surface which, with the inside of the fairing surface element, define a substantially circular rotational surface with a diameter sufficient to circumscribe the bundled cylindrical elements.

The rotational surfaces about the inside of the fairing and the interfacing bearing surfaces between fairings and between fairings and clamps allow the fairings to rotate freely to orient with the current.

Embodiments of the present invention can facilitate installation and retrieval and provide a very simple design in which the end pieces efficiently serve to act as 1) fairing closures, 2) radial bearings, and 3) thrust bearings.

Other modifications, changes, and substitutions are also intended in the forgoing disclosure. Further, in some instances, some features of the present invention will be employed without a corresponding use of other features described in these illustrative embodiments. Accordingly, it is appropriate that the appended claims be construed broadly and in a manner consistent with the spirit and scope of the invention herein.

What is claimed is:

1. A fairing system for protecting multiple, parallel, bundled, cylindrical elements deployed in offshore applications, said fairing system comprising:

a plurality of elongated fairing surface elements foldable about an axis and having elongated edges;

a connection system joining the elongated edges of the fairing surface elements in a folded manner about the axis;

a plurality of thrust bearing assemblies at orthogonally connected across each axial end of the fairing surface elements;

an axially extending circular rotational surface defined by the interior of each of the folded fairing surface elements and a transverse edge of the thrust bearing assemblies connected thereto, said rotational surface having a diameter which circumscribes the bundled cylindrical elements;

a plurality of clamps interconnecting the bundled, cylindrical elements; and a bearing collar on the axial ends of the clamps.

2. A fairing system in accordance with claim 1 wherein the multiple, parallel, bundled cylindrical elements are a tandem set.

3. A fairing system in accordance with claim 2 wherein the tandem set of cylindrical elements comprises a wireline and a drilling riser control pod hose.

4. A fairing system in accordance with claim 1 wherein the elongated fairing surface elements are formed from sheets of resilient plastic.

5. A fairing system in accordance with claim 4 wherein the thrust bearing assemblies connected orthogonally across each axial end of the fairing surface elements comprises:

a first element connected to the fairing surface element;

a second element connected to the fairing surface element;

a bearing surface; and wherein the connection system joining the elongated edges of the fairing surface elements comprises:

a latch pin carried on the first element of the thrust bearing;

a latch pin receiving receptacle on the second element of the thrust bearing;

a locking recess in the latch pin receiving receptacle; and a detent finger projecting from the latch pin transverse to its axial reception within the latch pin receiving receptacle and selectively engagable within the locking recess.

6. A fairing system in accordance with claim 5 wherein the connection system joining the elongated edges of the fairing surface elements further comprises:

a guide pin carried on the first element;

a corresponding guide pin receptacle in the second element.

7. A fairing system in accordance with claim 6 wherein the connection system joining the elongated edges of the fairing surface elements further comprises:

a plurality of tail clips.

8. A fairing system for protecting tandem, bundled, cylindrical elements deployed in offshore applications, said fairing system comprising:

a plurality of elongated fairing surface elements foldable about an axis and having elongated edges;

a connection system joining the elongated edges of the fairing surface elements in a folded manner about the axis;

a plurality of thrust bearing assemblies connected orthogonally across each axial end of the fairing surface elements;

an axially extending circular rotational surface defined by the interior of each of the fairing folded fairing surface elements and a transverse edge of the thrust bearing assemblies connected thereto, said rotational surface having a diameter which circumscribes the tandem, bundled cylindrical elements;

a plurality of clamps interconnecting the bundled, cylindrical elements; and a bearing collar on the axial ends of the clamps.

9. A fairing system for protecting multiple, parallel, bundled, cylindrical elements deployed in offshore applications, said fairing system comprising:

a plurality of elongated fairing surface elements formed from sheets of resilient plastic foldable about an axis;

a plurality of thrust bearing assemblies connected orthogonally across each axial end of the fairing surface elements, comprising:

a first element connected to the fairing surface element;

a second element connected to the fairing surface element;

a bearing surface;

a connection system joining the elongated edges of the fairing surface elements in a folded manner about the axis, comprising:

a latch pin carried on the first element of the thrust bearing assembly;

a latch pin receiving receptacle on the second element of the thrust bearing;

a locking recess in the latch pin receiving receptacle; and a detent finger projecting from the latch pin transverse to its axial reception within the latch pin receiving receptacle and selectively engagable within the locking recess;

an axially extending circular rotational surface defined by the interior of each of the folded fairing surface elements and a transverse edge of the thrust bearing assemblies connected thereto, said rotational surface having a diameter which circumscribes the bundled cylindrical elements;

a plurality of clamps interconnecting the bundled, cylindrical elements; and a bearing collar on the axial ends of the clamps.

10. A fairing system in accordance with claim 9 wherein the connection system joining the elongated edges of the fairing surface elements further comprises:

a guide pin carried on the first element; and a corresponding guide pin receptacle in the second element.

11. A fairing system in accordance with claim 10 wherein the connection system joining the elongated edges of the fairing surface elements further comprises:

a plurality of tail clips.

* * * * *